US007537470B2

(12) United States Patent
Yamaguchi

(10) Patent No.: US 7,537,470 B2
(45) Date of Patent: May 26, 2009

(54) EJECTION MECHANISM AND CARD CONNECTOR

(75) Inventor: Katsumi Yamaguchi, Saitama (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 12/039,398

(22) Filed: Feb. 28, 2008

(65) Prior Publication Data

US 2008/0207025 A1 Aug. 28, 2008

(51) Int. Cl.
*H01R 13/62* (2006.01)

(52) U.S. Cl. ..... 439/159; 439/67; 439/630

(58) Field of Classification Search ..... 439/64, 439/67, 84, 159, 160, 630
See application file for complete search history.

(56) References Cited

U.S. PATENT DOCUMENTS 6,159,027 A * 12/2000 Kuo ..... 439/159
6,176,714 B1 * 1/2001 Ishida et al. ..... 439/159
6,478,590 B1 * 11/2002 Kuo ..... 439/159
6,796,816 B2 * 9/2004 He ..... 439/159
6,890,195 B2 * 5/2005 Nagata ..... 439/159
2008/0207025 A1 * 8/2008 Yamaguchi ..... 439/159
2008/0254658 A1 * 10/2008 Wang et al. ..... 439/159

FOREIGN PATENT DOCUMENTS

JP 2006-040634 2/2006

* cited by examiner

*Primary Examiner*—James Harvey
(74) *Attorney, Agent, or Firm*—Barley Snyder LLC

(57) ABSTRACT

An ejection mechanism for a connector is disclosed. The connector has a housing that carries contacts, a frame attached to the housing for guiding insertion and removal of a card, and a pivot arm disposed in the housing that ejects the card toward a removal side by pivoting. The ejection mechanism has a cover connected to the frame, a push bar having a push button. The ejection mechanism also has a cam groove plate with a cam groove connected to the cover. The ejection mechanism also has a cam pin connected to the push bar and received within the cam groove. The ejection mechanism also has a push plate having a restricting hole that receives the cam pin and the push plate is configured to pivot the pivot arm in reaction to movement of the push button.

20 Claims, 10 Drawing Sheets

EJECTION MECHANISM AND CARD CONNECTOR

CROSS-REFERENCE TO RELATED APPLICATION DATA

This application claims the benefit of the earlier file Japanese Patent Application No. 2007-49713 having a filing date of Feb. 28, 2007.

FIELD OF THE INVENTION

The present invention relates to a card connector.

BACKGROUND

The conventional card connector shown in Prior Art FIGS. 11A to 11C (see JP2006-40634A) is known to comprise an ejection mechanism.

The card connector 200 shown in Prior Art FIGS. 11A to 11C and Prior Art FIGS. 12A to 12C is installed in the housing (not shown in the figures) of a personal computer or the like, and comprises a connector part 210 into which a card C is inserted. The card connector 200 also comprises a card ejection means 220.

The connector part 210 comprises a housing 211 and a guide arm 212 that is provided on one end of the housing 211 in the direction of length and that protrudes forward.

As is shown in FIGS. 11A and 11B, the card ejection means 220 comprises a pivoting arm 221 that is disposed in the housing 211 of the connector part 210 in a pivotable manner, a push bar 223 that is movable in the direction of insertion and removal of the card C along the side surface of the guide arm 212, and a push plate 225 that is supported by the push bar 223 in a pivotable manner and that pushes and causes the pivoting arm 221 to pivot during the ejection of the card C.

The pivoting arm 221 is disposed inside the housing 211 in a pivotable manner; this pivoting arm 221 comprises a card contact part (not shown in the figures) that contacts the inserted card C at one end portion of this pivoting arm 221 on the inside of the housing 211, and also comprises a plate contact part 222 that contacts the push part 225b (described later) of the push plate 225 at the other end portion of this pivoting arm 221 on the outside of the housing 211. Furthermore, the pivoting arm 221 is designed to eject the inserted card C toward the removal side by pivoting.

As is shown in FIG. 11B, the push bar 223 is disposed so as to be movable in the direction of insertion and removal of the card C along the outer surface of the guide arm 212. A reinforcing rib 223c extends in the forward-rearward direction in the central portion of the push bar 223. Moreover, a slit 223a is formed to the rear side of the reinforcing rib 223c. A circular hole 223b whose diameter is greater than that of the slit 223a is formed at the front end portion of this slit 223a. A push button 224 for allowing the push operation of the push bar 223 is provided at the front end portion of the push bar 223. A tension spring 228 for constantly pulling the push bar 223 toward the front is provided between the push button 224 and guide arm 212.

As is shown in FIG. 12C, the push plate 225 is disposed along the inside of the push bar 223. An L-shaped supporting part 225a that protrudes outward is formed by bending at the central portion in the forward-rearward direction of the push plate 225. The supporting part 225a enters the circular hole 223b formed in the push bar 223, and the tip end of the supporting part 225a is positioned over the slit 223a of the push bar 223. As a result, the push plate 225 is supported in a pivotable manner with respect to the push bar 223. Furthermore, a push part 225b that contacts the plate contact part 222 of the pivoting arm 221 during the ejection of the card C is formed at the rear end portion of the push plate 225. Moreover, the front end portion of the push plate 225 is slightly inclined inward, and a cam pin 225c with a flange is attached to the tip end of the push plate 225 so as to protrude inward.

A cam groove 226 with which the cam pin 225c mates is formed in the outer surface of the guide arm 212 as shown in FIG. 11B. The cam groove 226 is formed into a heart-shaped loop.

A cam mechanism is constructed from the heart-shaped cam groove 226 formed in the outer surface of the guide arm 212 and the cam pin 225c that mates with this cam groove 226. Then, this cam mechanism makes it impossible to reverse the pulling action of the push bar 223 and push plate 225 toward the front (toward the removal of the card C) and the pressing action of the push bar 223 and push plate 225 toward the rear (toward the insertion of the card C).

Moreover, as is shown in FIG. 12A, a push bar movement restricting plate 227 is attached near the plate contact part 222 of the pivoting arm 221. The push bar movement restricting plate 227 is disposed on the inside of the push plate 225 so as to be movable in the forward-rearward direction. The push bar movement restricting plate 227 comprises a base plate part 227a that extends in the forward-rearward direction. An opening 227b where the pivoting arm 221 enters is formed in the rear portion of the base plate part 227a. Furthermore, an inclined part 227c that is inclined downward obliquely toward the front is formed in the front portion of the base plate part 227a with the width thereof being reduced gradually after being bent inward, and a restricting part 227d is formed facing forward from this inclined part 227c. In addition, the inclined part 227c and restricting part 227d are positioned on the outer surface of the guide arm 212. The restricting part 227d is designed to contact the side surface of the flange of the cam pin 225c when the card C is not in contact with the card contact part of the pivoting arm 221, so that the push plate 225 is prevented from pivoting in the clockwise direction with respect to the push bar.

In the card connector 200, as a result of the push operation of the push bar 223 that has the push button 224, the push plate 225 is pushed to cause the pivoting arm 221 to pivot so that the card C can be ejected.

Furthermore, when the card is inserted into a specified position, as a result of providing the push bar movement restricting plate 227 that restricts the movement of the push bar 223, the push button 224 does not protrude from the housing unless the card C is inserted into the specified position (hereafter referred to as "pop-push mechanism").

However, in the card connector 200 shown in Prior Art FIGS. 11A to 11C, because the shape of the push bar movement restricting plate 227 for realizing the pop-push mechanism is complicated, there is a problem in that such card connectors 200 are not suitable for mass production.

In the card connector 200, furthermore, because the cam groove 226 is formed in the outer surface of the guide arm 212 of the connector part 210, it is necessary to change the design of the connector part 210 in cases where the disposition of the card ejection means 220 is changed to the opposite side of the housing 211 in the direction of length. Accordingly, the card connector 200 has the problem of difficulty in changing the disposition of the card ejection means 220 with respect to the housing 211 to the opposite side in the direction of length.

Some customers request card connectors with a so-called push-push mechanism that allows the protrusion of the push button from the housing even in a state in which the card C is not inserted into the specified position (hereafter simply referred to as "push-push mechanism"), instead of the pop-push mechanism. With the connector 200, however, it is problematic that various parts must be redesigned in order to realize the requested push-push mechanism.

SUMMARY

The present invention relates to, in one embodiment among others, an ejection mechanism for a connector. The connector has a housing that carries contacts, a frame attached to the housing for guiding insertion and removal of a card, and a pivot arm disposed in the housing that ejects the card toward a removal side by pivoting. The ejection mechanism has a cover connected to the frame, a push bar having a push button, and the push bar is slideable within the cover in a direction of insertion and removal of the card. The ejection mechanism also has a cam groove plate connected to the cover and the cam groove plate has a heart-shaped cam groove formed in a side surface of the cam groove plate. The ejection mechanism also has a cam pin connected to the push bar and received within the cam groove. The ejection mechanism also has a push plate having a restricting hole that receives the cam pin and the push plate is configured to pivot the pivot arm in reaction to movement of the push button.

DETAILED DESCRIPTION OF THE EMBODIMENT(S)

Figure 1B:
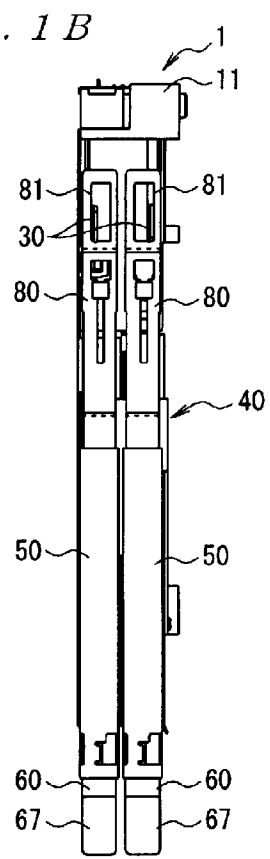
FIG. 1B is an orthogonal right side view of the card connector of FIG. 1A.

Next, an embodiment of the present invention will be described with reference to the figures.

A card connector 1 shown in FIGS. 1A to 1D is installed in the housing (not shown in the figures) of a personal computer or the like, and comprises a connector part 10, a metal frame (frame) 20, and an ejection mechanism 40. The ejection mechanism 40 according to the present invention is mainly provided in a card connector 1, and is used to eject the card C inserted in the card connector 1.

The connector 10 comprises a rectangular-solid-form housing 11 that extends in the direction of length (left-right direction in FIG. 1A) and a plurality of contacts 16 that are secured in the housing 11 along the direction of length.

The housing 11 is formed by molding an insulating resin. Mounts 14 for mounting the housing 11 on a circuit board (not shown in the figures) are provided on the respective end portions of the housing 11 in the direction of length, and a mount aperture 15 is formed in each of the mounts 14.

Each of the contacts 16 is formed by stamping and forming a metal plate, and is designed to be connected by soldering to a circuit board 17 and to make mating contact with a card C such as a memory card that is inserted into the connector 10.

Figure 1A:
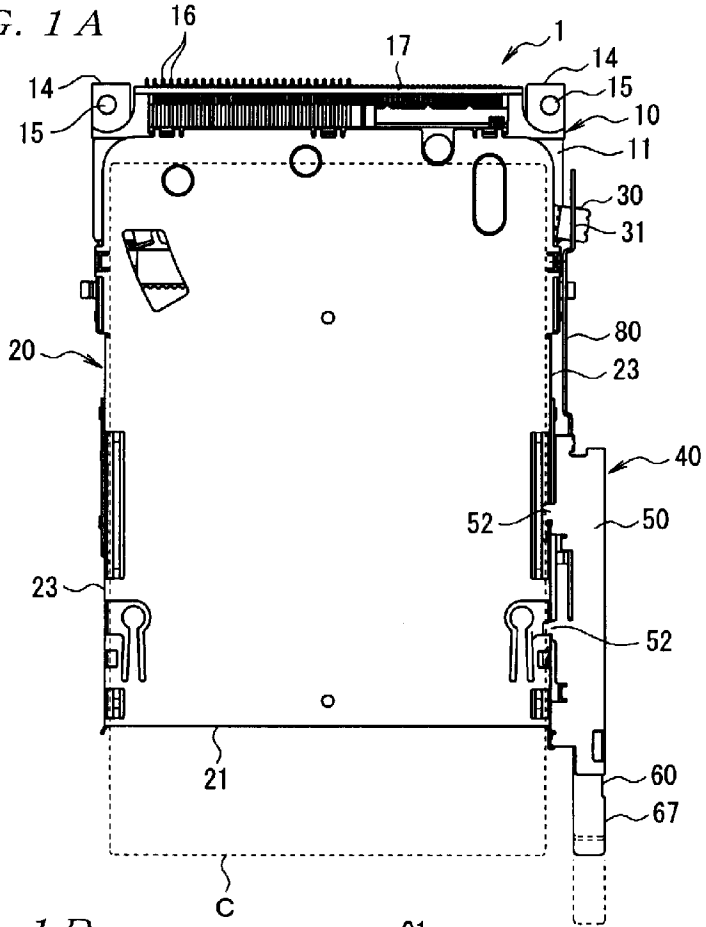
FIG. 1A is an orthogonal top view of a card connector comprising an ejection mechanism according to the present invention.
Figure 1D:
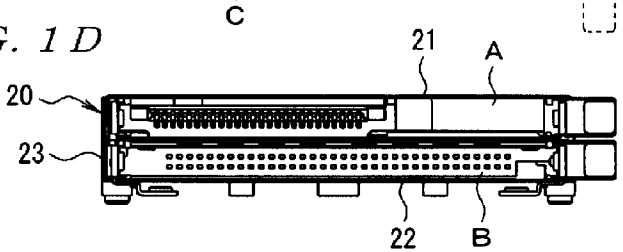
FIG. 1D is an orthogonal front view of the card connector of FIG. 1A.
Figure 1C:
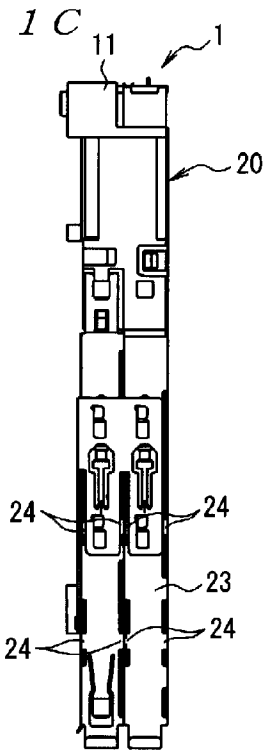
FIG. 1C is an orthogonal left side view of the card connector of FIG. 1A.

The metal frame 20 is disposed to the front of the housing 11 (lower portion in FIG. 1A). The metal frame 20 comprises a flat top plate 21, a flat bottom plate 22, and a pair of side walls 23 that connect the top plate part 21 and bottom plate 22. Furthermore, a double slot comprising slots A and B in two stages in the vertical direction (vertical direction in FIG. 1D) is constructed from a space surrounded by the top plate 21, two side walls 23, and bottom plate 22 of the metal frame 20, and the card C is guided by the inner surfaces of the two side walls 23 of the metal frame 20 such that this card C can be inserted and removed. Moreover, eight tab retainers 24 with which the tabs 52 of covers 50 mate are provided on each of the side walls 23 as shown in FIG. 1C.

As is shown in FIGS. 1A to 1D and 2, each of the ejection mechanisms 40 comprises a pivot arm 30, a cover 50 that is fastened along the outer surface of the corresponding side wall 23, a push bar 60 that slides inside the cover 50, a cam groove plate 70 that is fastened to the cover 50, and a push plate 80 that is combined with the push bar 60 and that pushes and causes the pivot arm 30 to pivot during the ejection of the card C.

The pivot arm 30 is disposed inside the housing 11 in a pivotable manner. The pivot arm 30 comprises a card contact part (not shown in the figures) that contacts the inserted card C on one end portion of this pivot arm 30 inside the housing 11, and also comprises a push plate interface 31 with which the arm interface 81 (described later) of the push plate 80 mates on the other end portion of this pivot arm 30 on the outside of the housing 11. The pivot arm 30 is designed to eject the inserted card C toward the card removal side (toward the front, which is toward the lower portion in FIG. 1A) as a result of pivoting.

Figure 2:
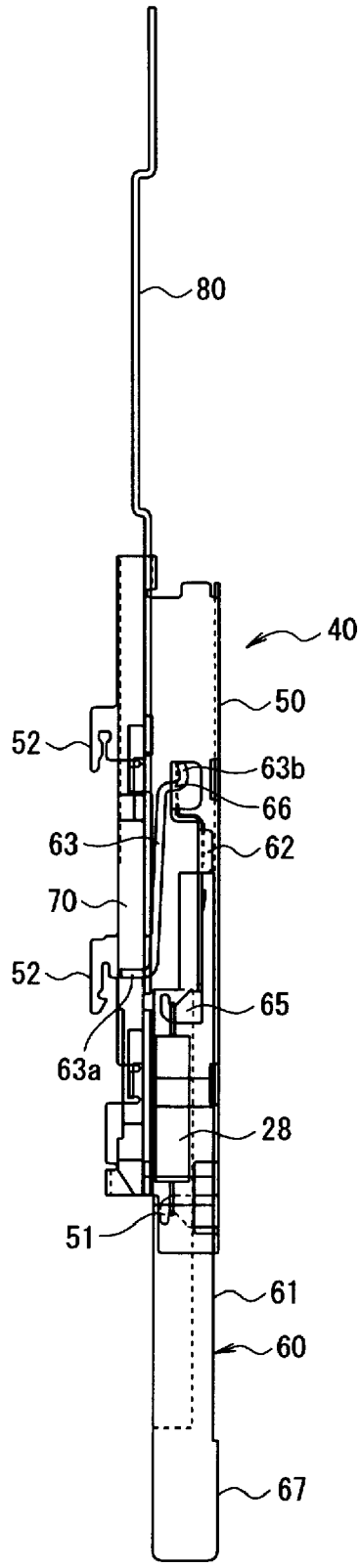
FIG. 2 is a an orthogonal top view of the ejection mechanism of the card connector of FIG. 1A.
Figure 3A:
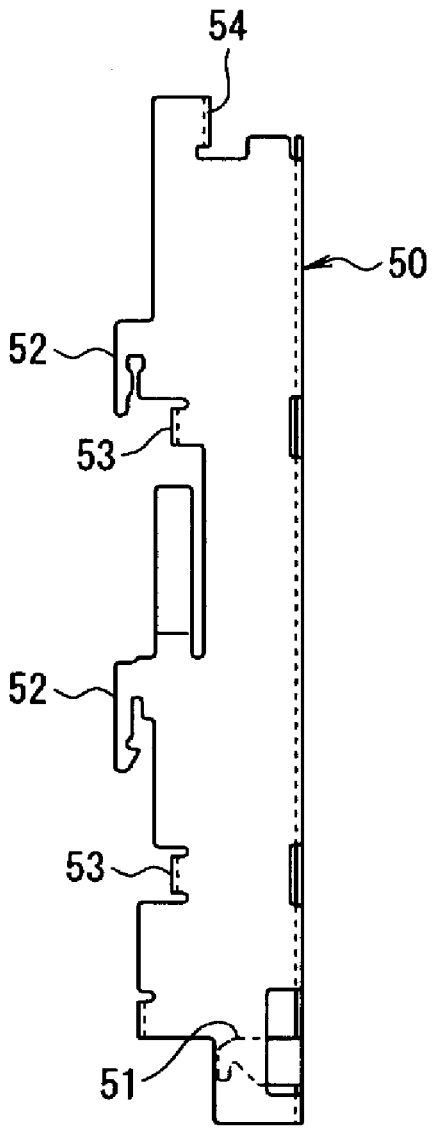
FIG. 3A is an orthogonal top view of a cover of the ejection mechanism of FIG. 2.
Figure 3B:
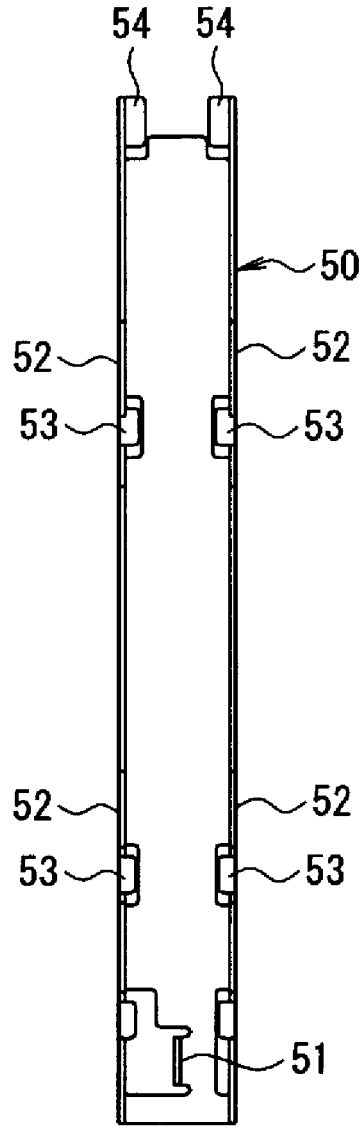
FIG. 3B is an orthogonal left side view of the cover of FIG. 3A.

As is shown in FIGS. 2, 3A, and 3B, the cover 50 is constructed with a cross-sectional C shape that extends in the direction of insertion and removal of the card C (vertical direction in FIGS. 2, 3A, and 3B). The cover member is, in this embodiment, formed by stamping and forming a metal plate. A first spring latch 51 that latches on one end portion of a tension spring 28 (described later) is formed by bending on the bottom surface of the cover 50. Two tabs 52 for attaching the cover 50 to the corresponding side wall 23 are provided so as to protrude from each of the end surfaces on the side of the opening of the cover 50. Moreover, two claws 53 for attaching the cam groove plate 70 are provided so as to protrude from each of the end surfaces on the side of the opening of the cover 50. A pair of supports 54 that support the push plate 80 are formed by bending on the rear end portions of the cover 50.

As is shown in FIG. 2, the push bar 60 comprises a body 61 that extends in the direction of insertion and removal of the card C, a link 62 that is disposed at the rear end portion of the body 61, and a cam pin 63 that is attached to the link 62.

Figure 4A:
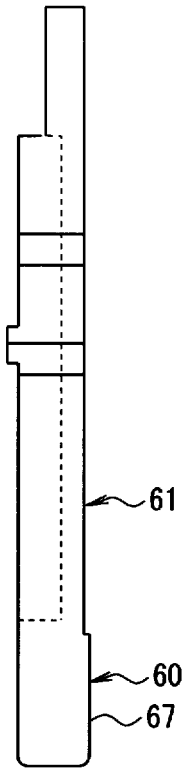
FIG. 4A is an orthogonal top view of a body of a push bar of the ejection mechanism of FIG. 2.
Figure 4B:
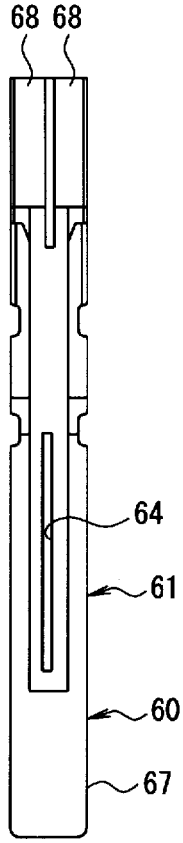
FIG. 4B is an orthogonal left side view of the body of FIG. 4A.

As is shown in FIGS. 4A and 4B, the body 61 is constructed with a cross-sectional C shape, and in this embodiment, is formed by thermoforming a resin. An insertion hole 64 into which the first spring latch 51 of the cover 50 is inserted is formed in the bottom surface of the body 61. A push button 67 for allowing the push operation of the push bar 60 is formed at the front end portion of the body 61. A pair of sandwich plates 68 that sandwich the link plate 69 of the link 62 between these sandwich plates 68 and the bottom surface of the body 61 are provided at the rear end portion of the body 61.

Figure 5A:
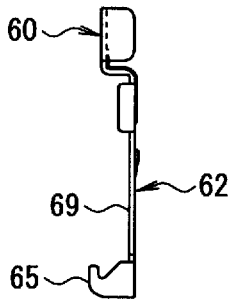
FIG. 5A is an orthogonal top view of a link of the push bar of the ejection mechanism of FIG. 2.
Figure 5B:
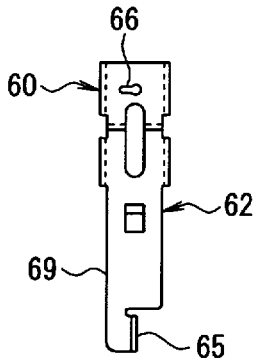

As is shown in FIGS. 5A and 5B, the link 62 is constructed in a flat plate form, and is formed by stamping and forming a metal plate. A second spring latch 65 that latches on the other end portion of the tension spring 28 (described later) is provided so as to protrude from the front end portion of the link 62. A hook hole 66 with which the cam pin 63 mates is formed in the front end portion of the link 62. Furthermore, a flat plate-like link plate 69 that is inserted between the bottom surface and two sandwich plates 68 of the body 61 is formed at the front end portion of the link 62.

Moreover, the body 61 and link 62 are combined into an integral unit as a result of the link plate 69 of the link 62 being inserted between the bottom surface and two sandwich plates 68 of the body 61.

Figure 6:
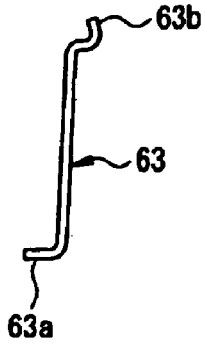

As is shown in FIG. 6, the cam pin 63 is formed from a rod-form body made of metal that extends in the direction of insertion and removal of the card C. A pin finger 63*a* that mates with a cam groove 71 (described later) is formed by bending at the front end portion of the cam pin 63. An S-shaped hook 63*b* that mates with the hook hole 66 in the link 62 is formed by bending at the rear end portion of the cam pin 63.

Furthermore, as is shown in FIG. 2, the cam pin 63 is attached to the link 62 by the hook 63*b* mating with the hook hole 66. In this case, the cam pin 63 is attached so as to extend forward from the hook hole 66. Moreover, the cam pin 63 is attached such that the pin finger 63*a* extends toward the cam groove plate 70.

Figure 7A:
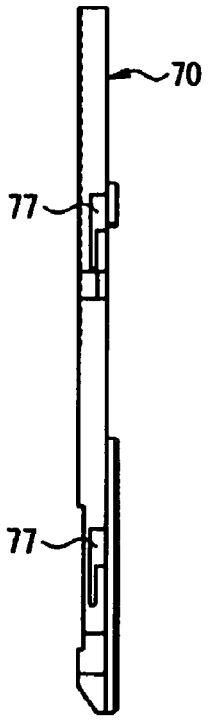
Figure 7B:
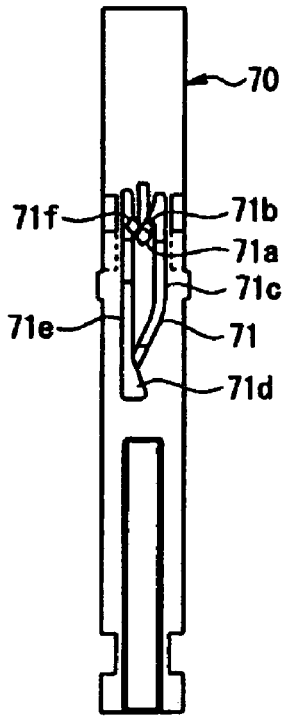

As is shown in FIGS. 7A and 7B, the cam groove plate 70 is formed from a plate-like body that extends in the direction of insertion and removal of the card C, and in this embodiment, is formed by thermoforming a resin. A heart-shaped cam groove 71 with which the pin finger 63*a* mates is formed in the side surface of the cam groove plate 70 as shown in FIG. 7B. Two claw recesses 77 with which the claws 53 of the cover 50 respectively mate are formed in each of the end surfaces of the cam groove plate 70 in the vertical direction (left-right direction in FIG. 7B) as shown in FIG. 7A.

As is shown in FIG. 7B, the cam groove 71 comprises a rear recess 71*a* that is formed in the central portion of the cam groove plate 70 in the direction of insertion and removal of the card C, a first channel 71*b* that is inclined downward obliquely toward the rear from this rear recess 71*a,* and a second channel 71*c* that first extends rearward from the tip end of the first channel 71*b* and then extends forward. The cam groove 71 further comprises a front recess 71*d* which is formed in a position that is upward (left portion in FIG. 7B) obliquely toward the front from the front end of the second channel 71*c,* a third channel 71*e* which extends rearward from the front recess 71*d,* and a fourth channel 71*f* which extends from the rear end of the third channel 71*e* toward the rear recess 71*a*. Accordingly, the cam groove 71 is formed in a heart-shaped loop.

Moreover, the heart-shaped cam groove 71 that is formed in the side surface of the cam groove plate 70 and the pin finger 63*a* that mates with this cam groove 71 make up a cam mechanism, and this cam mechanism makes it impossible to reverse the pulling action of the push bar 60 toward the front (toward the removal of the card C) and the pressing action of the push bar 60 toward the rear (toward the insertion of the card C). In other words, the pin finger 63*a* successively moves in one direction along the loop-form cam groove 71, and does not move in the opposite direction.

Figure 8A:
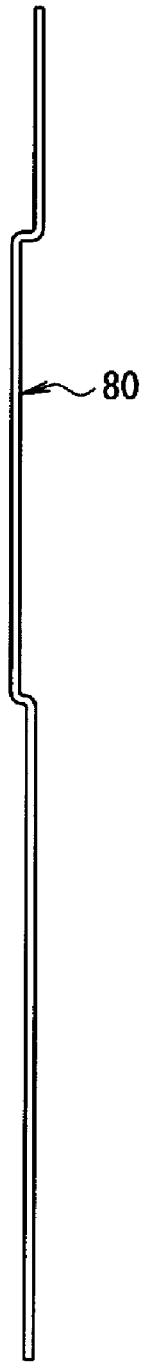
Figure 8B:
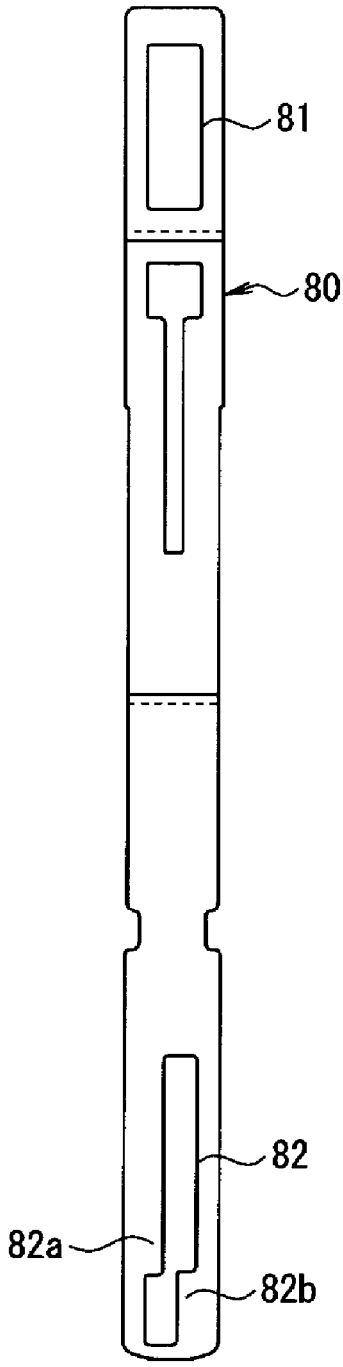

As is shown in FIGS. 8A and 8B, the push plate 80 is formed in a plate-like body that extends in the direction of insertion and removal of the card C, and in this embodiment, is formed by stamping and forming a metal plate. An arm interface 81 with which the push plate interface 31 of the pivot arm 30 mates is formed, in this embodiment, by stamping at the rear end portion of the push plate 80. A cam pin hole 82 into which the pin finger 63*a* of the cam pin 63 of the push bar 60 is inserted is formed by stamping in the front end portion of the push plate 80.

The cam pin hole 82 extends in the direction of insertion and removal of the card C as shown in FIG. 8B, and a first protrusion 82*a* is provided above the rear end portion of the cam pin hole 82, while a second protrusion (restricting protruding part) 82*b* that restricts the movement of the pin finger 63*a* is provided below the front end portion of the cam pin hole 82.

Furthermore, as is shown in FIG. 2, the push bar 60 is disposed on the inside of the cover 50 in a state in which the push button 67 protrudes forward from the cover 50. In this case, the latch piece 51 of the cover 50 is inserted into the insertion hole 64 of the push bar 60. Moreover, one end portion of the tension spring 28 is latched by the latch piece 51, and the other end portion of the tension spring 28 is latched by the latch piece 65. As a result, the push bar 60 can slide in the direction of insertion and removal of the card C on the inside of the cover 50 in a state in which this push bar 60 is constantly pulled forward with respect to the cover 50.

In addition, as is shown in FIG. 2, the cam groove plate 70 is attached to the cover 50 by the claws 53 of the cover 50 respectively mating with the claw recesses 77 in a state in which the cam groove 71 faces toward the push bar 60. In this case, the pin finger 63*a* of the cam pin 63 of the push bar 60 mates with the cam groove 71 of the cam groove plate 70.

Furthermore, the push plate 80 is supported by the two supports 54 of the cover 50, and is disposed on the inside of the cover 50 in a state in which the arm interface 81 protrudes rearward from the cover 50 as shown in FIG. 2. In this case, the push plate 80 is disposed between the push bar 60 and cam groove plate 70, and the pin finger 63*a* of the cam pin 63 is inserted into the cam pin hole 82 of the push plate 80. Moreover, the push plate interface 31 of the pivot arm 30 mates with the arm interface 81 of the push plate 80 as shown in FIG. 1A.

Furthermore, each of the ejection mechanisms 40 formed in this manner is attached to the metal frame 20 by the respective tabs 52 of the cover 50 mating with the respective tab retainers 24 of the corresponding side wall 23.

Next, the action of each ejection mechanism 40 will be described with reference to FIGS. 9A to 9D.

In a state prior to the insertion of the card C, the push plate interface 31 of the pivot arm 30 is located in the rearmost position. Furthermore, as a result of the push plate interface 31 being located in the rearmost position, the push plate 80 is located in the rearmost position. At this point, furthermore, the push bar 60 (not shown in FIGS. 9A to 9D) is in a retracted position, and the pin finger 63*a* disposed on the push bar 60 is located in the rear recessed part 71*a* of the cam groove 71 in the cam groove plate 70 as shown in FIG. 9A. At this point, the upper surface of the second protrusion 82*b* provided to the cam pin hole 82 of the push plate 80 contacts the side surface of the pin finger 63*a,* so that the movement of the pin finger 63*a* to the first channel 71*b* is prevented. As a result, the forward movement of the push bar 60 is prevented. Accordingly, in a state in which the card C is not inserted, the pressing of the push bar 60 can be prevented.

Next, when the card C is inserted into the housing 11, the rear end portion of the card C contacts the card contact part of the pivot arm 30, and the pivot arm 30 pivots such that the push plate interface 31 moves forward as shown in FIGS. 1A to 1D. As a result, the push plate 80 advances as shown in FIG. 9B. This releases the contact between the upper surface of the second protrusion 82*b* provided to the cam pin hole 82 of the push plate 80 and the side surface of the pin finger 63*a*. Accordingly, the pin finger 63*a* is placed in a state in which this pin finger 63*a* can move to the first channel 71*b*. Consequently, the pressing of the push bar 60 becomes possible only when the insertion of the card C into the housing 11 is completed. Furthermore, when the insertion of the card C into the housing 11 is completed, the contacts 16 make mating contact with the card C, so that the card C and the circuit board 17 are electrically connected.

Next, when the push bar 60 is pressed, the pin finger 63*a* moves from the rear recessed part 71*a* to the rear end portion of the second channel 71*c* along the first channel 71*b*. When the pressing of the push bar 60 is stopped in this state, the pin finger 63*a* moves from the rear end portion of the second channel 71*c* to the front recess 71*d* along the second channel 71*c* as a result of the action of the tension spring 28 as shown in FIG. 9C. As a result, the push button 67 of the push bar 60 protrudes from the housing, so that the card C can be ejected in the next step.

Next, when the push bar 60 is pressed, the pin finger 63*a* moves along the third channel 71*e*, and the side surface of the pin finger 63*a* contacts the front end surface of the first protrusion 82*a* of the cam pin hole 82.

Figure 9D:
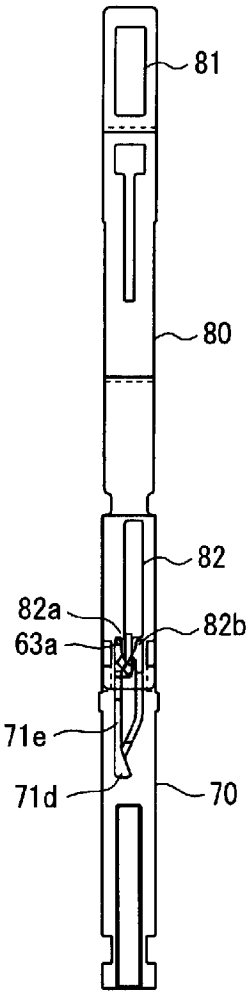
Figure 9C:
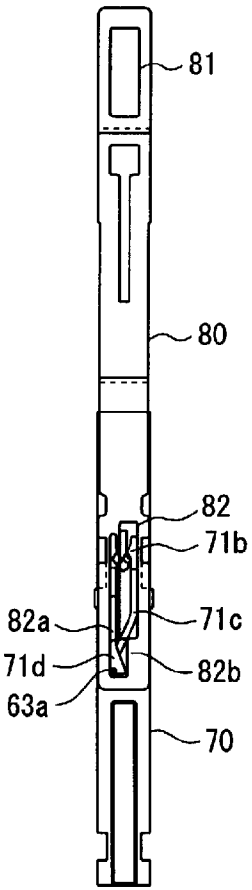
Figure 9B:
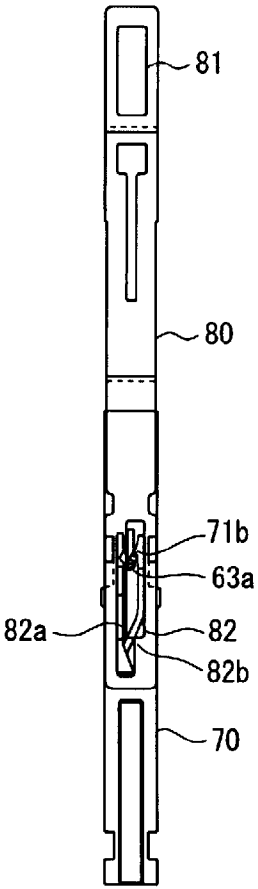
Figure 9A:
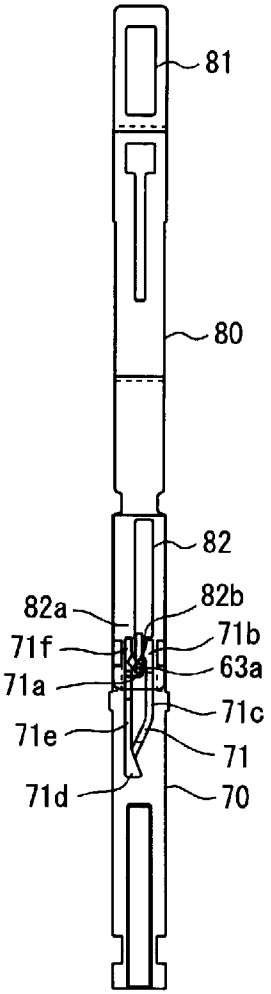

When the push bar 60 is pressed further, the pin finger 63*a* moves to the rear end portion of the third channel 71*e* as shown in FIG. 9D. In this case, the push plate 80 moves rearward as a result of the side surface of the pin finger 63*a* pressing the front end surface of the first protrusion 82*a* of the cam pin hole 82. Then, as the push plate 80 moves rearward, the pivot arm 30 pivots such that the push plate interface 31 moves rearward. As a result, the card contact part of the pivot arm 30 moves forward, and pushes the card C out, so that the card C inserted into the housing 11 is ejected slightly toward the front.

Next, when the pressing of the push bar 60 is stopped in a state in which the pin finger 63*a* is located at the rear end portion of the third channel 71*e*, the pin finger 63*a* moves from the rear end portion of the third channel 71*e* to the rear recess 71*a* along the fourth channel 71*f*. This positioning is shown in FIG. 9A and is a result of the action of the tension spring 28.

Thus, the push-push mechanism is accomplished by the ejection mechanism 40.

It would also be possible for each ejection mechanism 40 to have a construction in which the push plate 90 shown in FIGS. 10A to 10D is provided instead of the push plate 80.

The basic construction of the push plate 90 is substantially similar to that of the push plate 80. The push plate 90 differs from the push plate 80 in that no second protrusion 82*b* is provided to the cam pin hole 82 as shown in FIGS. 10A to 10D.

Next, the action of an ejection mechanism 40 comprising the push plate 90 will be described with reference to FIGS. 10A to 10D.

In a position prior to the insertion of the card C, the push plate interface 31 of the pivot arm 30 is located in the rearmost position. Furthermore, because the push plate interface 31 is located in the rearmost position, the push plate 90 is located in the rearmost position. At this point, furthermore, the push bar 60 is in a retracted position, and the pin finger 63*a* disposed on the push bar 60 is located in the rear recessed part 71*a* of the cam groove 71 in the cam groove plate 70 as shown in FIG. 10A. Here, there is no second protrusion 82*b* provided to the cam pin hole 82 in the push plate 90. Accordingly, the pin finger 63*a* is placed in a state in which this pin finger 63*a* can move to the first channel 71*b*. Consequently, the push bar 60 can be pushed toward the front. Moreover, when the push bar 60 is pressed, the pin finger 63*a* moves from the rear recessed part 71*a* to the rear end portion of the second channel 71*c* along the first channel 71*b*. When the pressing of the push bar 60 is stopped in this state, the pin finger 63*a* moves from the rear end portion of the second channel 71*c* to the front recess 71*d* along the second channel 71*c* as a result of the action of the tension spring 28 (see FIG. 10C). As a result, the push button 67 of the push bar 60 protrudes from the housing. In other words, with the ejection mechanism 40 comprising the push plate 90, the push button 67 can be caused to protrude from the housing even in a state in which the card C is not inserted. Furthermore, depending on the conditions under which the card connector 1 is used, there are cases in which it is more convenient if the push button 67 can be caused to protrude from the housing even in a state in which the card C is not inserted.

Meanwhile, when the card C is inserted into the housing 11 in the state shown in FIG. 10A, the rear end portion of the card C contacts the card contact part of the pivot arm 30, and the pivot arm 30 pivots such that the push plate interface 31 moves forward as shown in FIGS. 1A to 1D. As a result, the push plate 90 advances as shown in FIG. 10B. When the insertion of the card C into the housing 11 is completed, the contacts 16 make mating contact with the card C, so that the card C and the circuit board 17 are electrically connected.

Next, when the push bar 60 is pressed, the pin finger 63*a* moves from the rear recessed part 71*a* to the rear end portion of the second channel 71*c* along the first channel 71*b*. When the pressing of the push bar 60 is stopped in this state, the pin finger 63*a* moves from the rear end portion of the second channel 71*c* to the front recess 71*d* along the second channel 71*c* as a result of the action of the tension spring 28 as shown in FIG. 10C. As a result, the push button 67 of the push bar 60 protrudes from the housing, so that the card C can be ejected in the next step.

Next, when the push bar 60 is pressed, the pin finger 63*a* moves along the third channel 71*e*, and the side surface of the pin finger 63*a* contacts the front end surface of the first protrusion 82*a* of the cam pin hole 82.

Figure 10D:
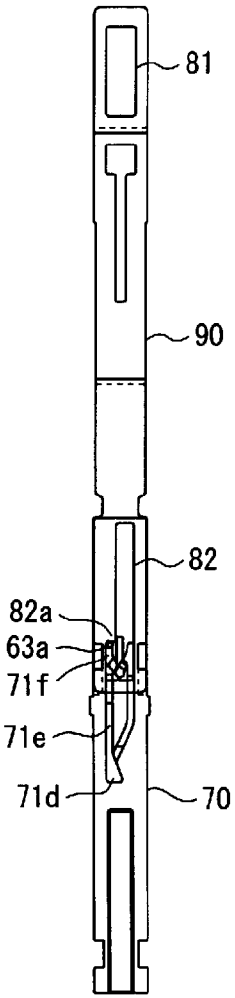
Figure 10C:
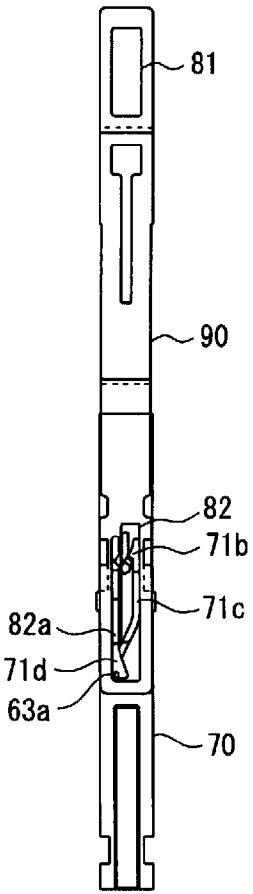
Figure 10B:
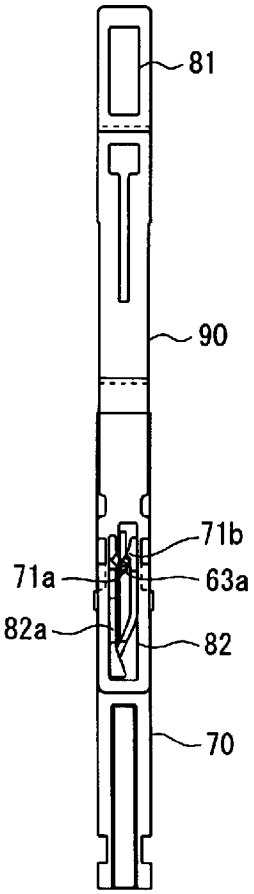
Figure 10A:
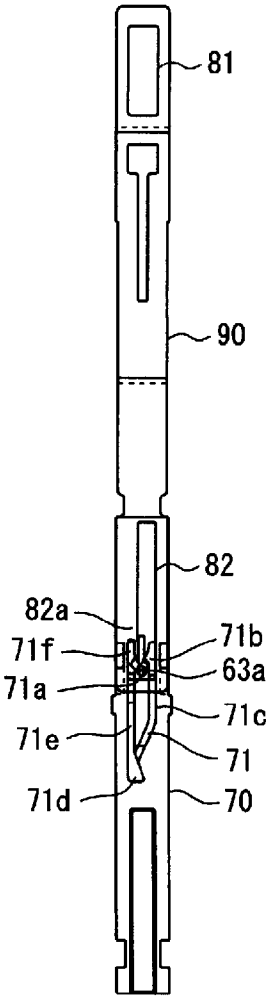
Figure 11B:
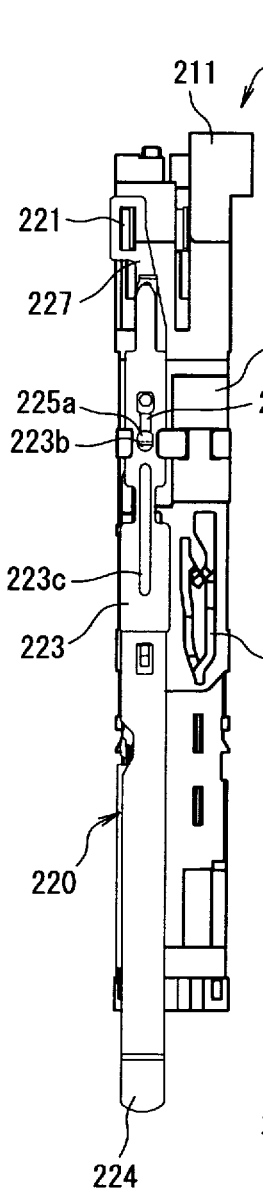
Prior Art FIG. 11B
Figure 11A:
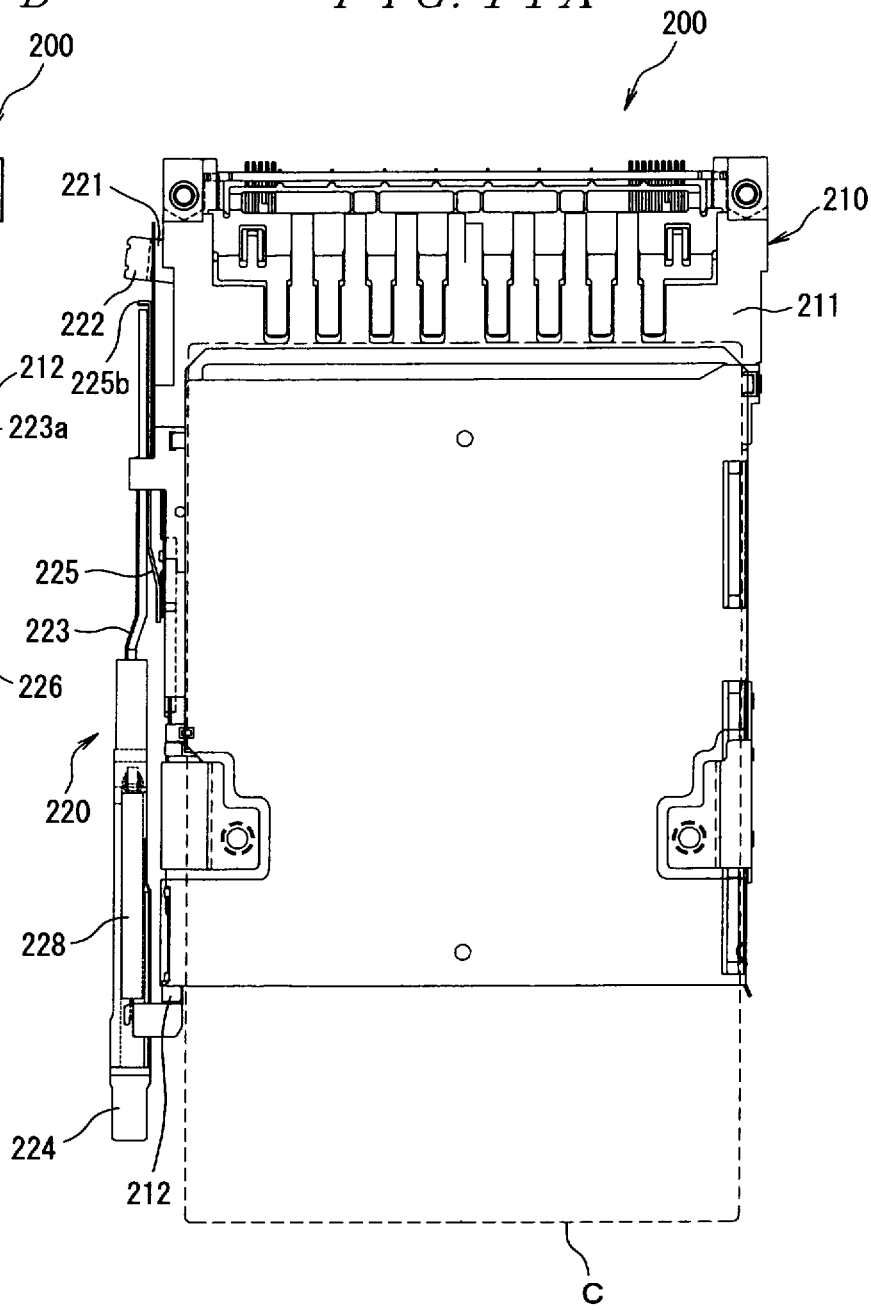
Prior Art FIG. 11A
Figure 11C:
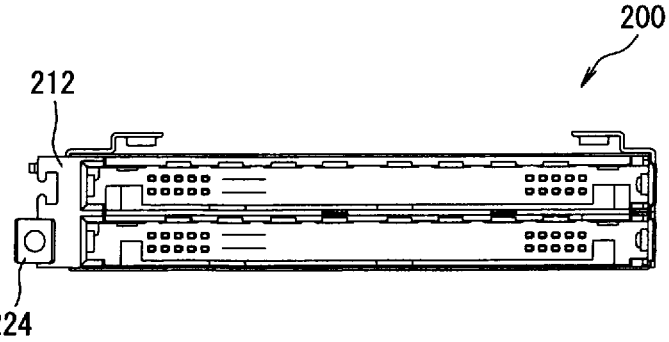
Prior Art FIG. 11C
Figure 12A:
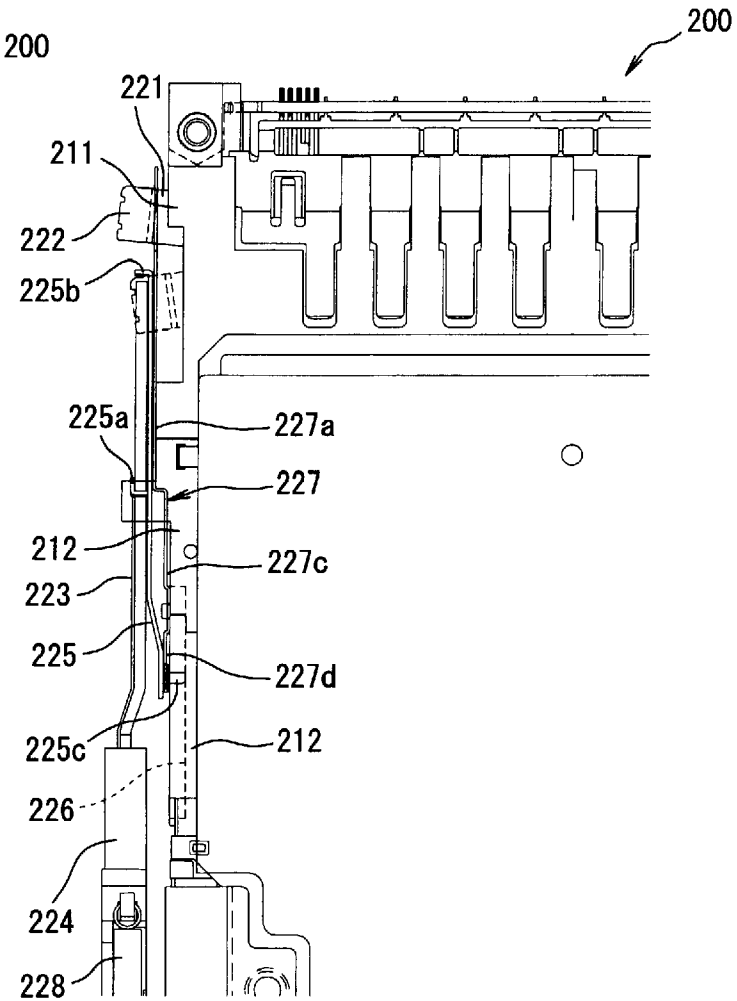
Prior Art FIG. 12A
Figure 12B:
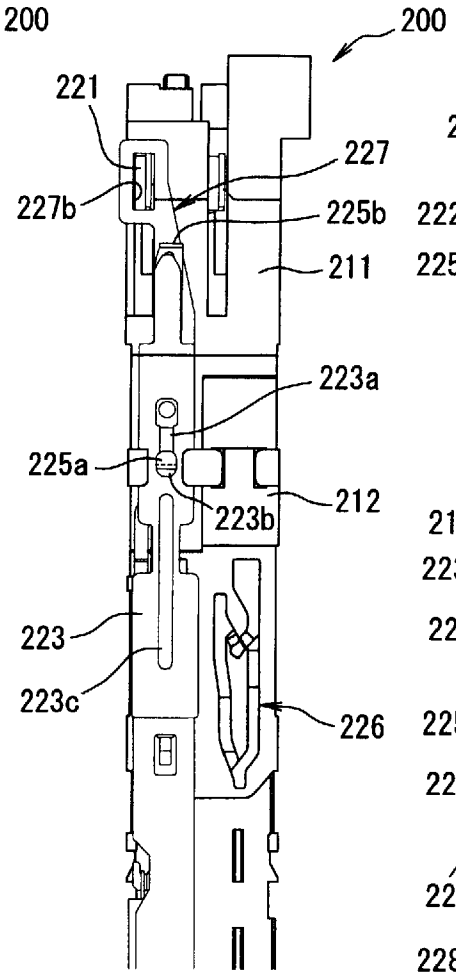
Prior Art FIG. 12B
Figure 12C:
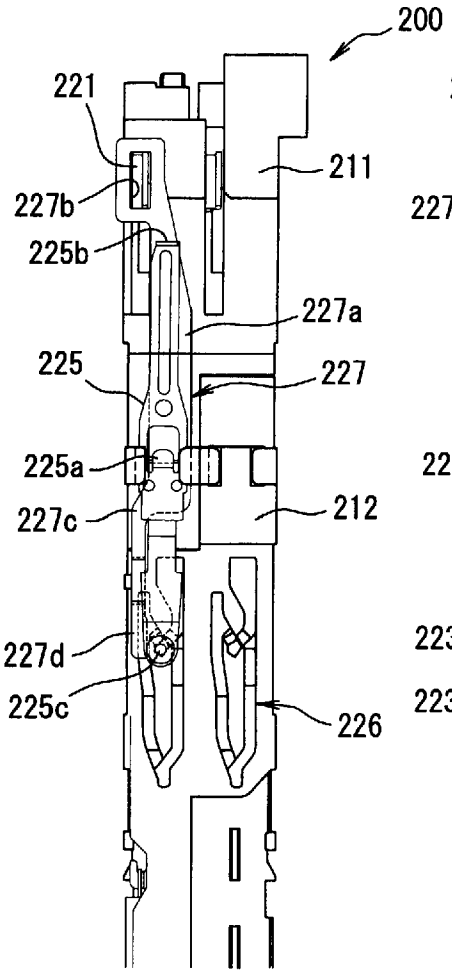
Prior Art FIG. 12C

When the push bar 60 is pressed further, the pin finger 63*a* moves to the rear end portion of the third channel 71*e* as shown in FIG. 10D. In this case, the push plate 90 moves rearward as a result of the side surface of the pin finger 63*a* pressing the front end surface of the first protrusion 82*a* of the cam pin hole 82. Then, as the push plate 90 moves rearward, the pivot arm 30 pivots such that the push plate interface 31 moves rearward. As a result, the card contact part of the pivot arm 30 moves forward, and pushes the card C out, so that the card C inserted into the housing 11 is ejected slightly toward the front.

Next, when the pressing of the push bar 60 is stopped in a state in which the pin finger 63*a* is located at the rear end portion of the third channel 71*e*, the pin finger 63*a* moves from the rear end portion of the third channel 71*e* to the rear recess 71*a* along the fourth channel 71*f*. This positioning is shown in FIG. 10A and is a result of the action of the tension spring 28.

Thus, the push-push mechanism is realized by the ejection mechanism 40 comprising the push plate 90.

Embodiments of the present invention have been described above. The ejection mechanisms 40 according to the present invention are suitable for mass production. The ejection mechanisms are constructed comprising a cam mechanism comprising a cam groove 71 formed in the cam groove plate 70 and a pin finger 63*a* disposed on the push bar 60. The ejection mechanism 40 further comprises either a push plate 80 or 90 that has a cam pin hole 82 for the insertion of the pin finger 63*a* and that causes the pivoting arm 30 to pivot.

Moreover, the ejection mechanism 40 makes enables easily changing the disposition of this ejection mechanism 40 with respect to the housing 11 to the opposite side in the direction of length. This is enabled, at least partly, because the cam groove plate 70 has a cam groove 71 formed therein that is independently provided.

In addition, with the ejection mechanism 40 of the card connector 1 according to the present invention, the change between the pop-push mechanism and push-push mechanism can be made easily by merely exchanging the push plate 80 and the push plate 90.

What is claimed is:

1. An ejection mechanism for a connector having a housing that carries contacts, a frame attached to the housing for guiding insertion and removal of a card, and a pivot arm disposed in the housing that ejects the card toward a removal side by pivoting, the ejection mechanism comprising:

a cover connected to the frame;

a push bar having a push button, the push bar being slideable within the cover in a direction of insertion and removal of the card;

a cam groove plate connected to the cover, the cam groove plate comprising a heart-shaped cam groove formed in a side surface of the cam groove plate;

a cam pin connected to the push bar and received within the cam groove; and a push plate having a restricting hole that receives the cam pin, the push plate being configured to pivot the pivot arm in reaction to movement of the push button.

2. The ejection mechanism according to claim 1, wherein the ejection mechanism is configured as a push-push mechanism.

3. The ejection mechanism according to claim 1, wherein the ejection mechanism is configured as a pop-push mechanism.

4. The ejection mechanism according to claim 1, wherein the push button protrudes from the housing while the card is not inserted into the housing.

5. The ejection mechanism according to claim 1, wherein the push bar can only be pressed upon when the card is fully inserted into the housing.

6. The ejection mechanism according to claim 1, the restricting hole comprising:

a first protrusion that guides movement of the cam pin.

7. The ejection mechanism according to claim 6, wherein the ejection mechanism is configured as a pop-push mechanism.

8. The ejection mechanism according to claim 1, the restricting hole comprising:

a first protrusion that guides movement of the cam pin; and a second protrusion that guides movement of the cam pin, the second protrusion being located opposite to the first protrusion and offset from the first protrusion along a length of the restricting hole.

9. The ejection mechanism according to claim 8, wherein the ejection mechanism is configured as a push-push mechanism.

10. The ejection mechanism according to claim 1, wherein the restricting hole has a first protrusion that allows movement of the cam pin along the cam groove when the card is inserted into the housing in a specified position.

11. A connector having a housing that carries contacts, a frame attached to the housing for guiding insertion and removal of a card, a pivot arm disposed in the housing that ejects the card toward a removal side by pivoting, and an ejection mechanism, the ejection mechanism comprising:

a cover connected to the frame;

a push bar having a push button, the push bar being slideable within the cover in a direction of insertion and removal of the card;

a cam groove plate connected to the cover, the cam groove plate comprising a heart-shaped cam groove formed in a side surface of the cam groove plate;

a cam pin connected to the push bar and received within the cam groove; and a push plate having a restricting hole that receives the cam pin, the push plate being configured to pivot the pivot arm in reaction to movement of the push button.

12. The connector according to claim 11, wherein the ejection mechanism is configured as a push-push mechanism.

13. The connector according to claim 11, wherein the ejection mechanism is configured as a pop-push mechanism.

14. The connector according to claim 11, wherein the push button protrudes from the housing while the card is not inserted into the housing.

15. The connector according to claim 11, wherein the push bar can only be pressed upon when the card is fully inserted into the housing.

16. The connector according to claim 11, the restricting hole comprising:

a first protrusion that guides movement of the cam pin.

17. The connector according to claim 16, wherein the ejection mechanism is configured as a pop-push mechanism.

18. The connector according to claim 11, the restricting hole comprising:

a first protrusion that guides movement of the cam pin; and a second protrusion that guides movement of the cam pin, the second protrusion being located opposite to the first protrusion and offset from the first protrusion along a length of the restricting hole.

19. The connector according to claim 18, wherein the ejection mechanism is configured as a push-push mechanism.

20. The connector according to claim 11, wherein the restricting hole has a first protrusion that allows movement of the cam pin along the cam groove when the card is inserted into the housing in a specified position.

* * * * *